US007559516B2

(12) United States Patent
Köder

(10) Patent No.: US 7,559,516 B2
(45) Date of Patent: Jul. 14, 2009

(54) HEIGHT-ADJUSTABLE FURNITURE LEG

(75) Inventor: Michael Köder, Plochingen (DE)

(73) Assignee: Kesseböhmer Produktions GmbH, Weilheim/Teck (DE)

( * ) Notice: Subject to any disclaimer, the term of this patent is extended or adjusted under 35 U.S.C. 154(b) by 0 days.

(21) Appl. No.: 11/739,130

(22) Filed: Apr. 24, 2007

(65) Prior Publication Data

US 2008/0035809 A1 Feb. 14, 2008

(30) Foreign Application Priority Data

Apr. 24, 2006 (DE) ..... 20 2006 007 006 U

(51) Int. Cl.
*F16M 11/26* (2006.01)
*A47B 9/00* (2006.01)

(52) U.S. Cl. ..... 248/188.5; 248/188.1; 248/161; 108/147

(58) Field of Classification Search ..... 248/188.5, 248/159, 157, 188.1, 188.2, 653, 654, 161, 248/346.01, 121, 346.03, 346.06, 346.5, 248/519, 354.1; 108/144, 146, 147
See application file for complete search history.

(56) References Cited

U.S. PATENT DOCUMENTS 2,439,869 A * 4/1948 Sharp ..... 297/296
2,857,226 A * 10/1958 Schenk ..... 108/147
2,947,556 A * 8/1960 Wenger ..... 403/290
3,236,485 A * 2/1966 Staples ..... 248/188.1
4,056,903 A * 11/1977 Guarnere ..... 52/126.4
4,673,155 A * 6/1987 Binder ..... 248/404
5,598,788 A * 2/1997 Jonker ..... 108/147
5,826,847 A * 10/1998 Warner et al. ..... 248/354.1
5,941,182 A * 8/1999 Greene ..... 108/147
6,070,840 A * 6/2000 Kelley et al. ..... 248/188.4
6,378,816 B1 * 4/2002 Pfister ..... 248/161
6,474,246 B2 * 11/2002 Hsu ..... 108/147
6,484,648 B1 * 11/2002 Long ..... 108/147
7,077,068 B1 * 7/2006 Agee ..... 108/147
7,195,216 B2 * 3/2007 Wang ..... 248/157
2006/0118682 A1 * 6/2006 Asquith et al. ..... 248/188.5

* cited by examiner

*Primary Examiner*—Anita M King
(74) *Attorney, Agent, or Firm*—Gudrun E. Huckett

(57) ABSTRACT

The furniture leg has a foot from which a lifting column projects transversely that comprises an external tube and an internal tube that is telescopingly movable relative to the external tube. The external tube is attached to a fastening part of the foot. In order to configure the furniture leg in such a way that the foot and the lifting column can be connected to one another such that deposit locations for dirt and the like are not formed, the exterior side of the external tube at least over most of its circumference passes continuously into the exterior side of the fastening part. In this way, at the transition from the foot to the lifting column no deposit location for dirt is formed. The furniture leg is suitable for tables of any kind, chairs, organ benches and the like.

8 Claims, 2 Drawing Sheets

HEIGHT-ADJUSTABLE FURNITURE LEG

BACKGROUND OF THE INVENTION

The invention concerns a height-adjustable furniture leg with at least one foot from which a lifting column projects transversely that comprises an external tube and at least one internal tube that can be moved relative to the external tube telescopingly, the latter being connected to a fastening part of the foot.

Height-adjustable furniture legs are known, for example, for worktables where the tabletop is to be adjusted to the right height. The lifting column is attached to the foot wherein at the transition from the foot or its fastening part to the lifting column a step is formed that is more or less large. The step not only presents an unpleasant appearance but also leads to dirt collecting on the step which dirt is difficult to remove.

It is an object of the invention to configure the furniture leg of the aforementioned kind such that the foot and the lifting column are connected to one another such that deposit locations where dirt and the like can deposit are not formed.

SUMMARY OF THE INVENTION

This object is solved for the furniture leg of the aforementioned kind in accordance with the invention such that the exterior side of the external tube, at least over most of its circumference, has a continuous transition into the exterior side of the fastening part.

In the furniture leg according to the invention, the exterior side of the external tube of the lifting column passes at least over most of its circumference, preferably about the entire circumference, continuously into the exterior side of the fastening part of the foot. In this way, at the transition from the foot into the lifting column no deposit location for dirt is formed. Instead, the topside of the foot has a continuous transition into the exterior side of the external tube. This continuous transition between foot and lifting column can be cleaned simply and without problems.

Advantageously, the fastening part projects past the topside of the foot. In this way, the external tube of the lifting column can be connected very simply to the foot.

The external tube is advantageously centered on the fastening part of the foot so that the external tube in a simple way can be aligned precisely relative to the foot during assembly.

Centering of the external tube on the foot is particularly advantageous when the fastening part of the foot at its end face has a recess that is engaged by the lower end of the external tube. It is then only necessary to insert the external tube with its lower end into the recess in order to center the external tube relative to the fastening part.

The transition between the external tube and the fastening part of the foot can be designed especially simply when the width of the recess matches the wall thickness of the external tube wherein advantageously the recess is open toward the exterior side of the fastening part. In this way, the external tube can be placed onto the fastening part such that, on the one hand, it is centered and, on the other hand, passes continuously with its exterior side into the external side of the fastening part.

The fastening part surrounds advantageously a recess in the foot. Advantageously, the interior tube, when in its lower position, projects into the recess. When the foot in the area of the fastening part is configured to be thicker in the lifting direction of the lifting column, the recess in the fastening part or in the foot can be relatively large so that the interior tube in its lower position can be retracted relatively far into the recess. This contributes in an advantageous way to a minimal height of the lifting column in the lower end position. The internal tube can thus have a sufficiently large length so that the lifting column has a great height in the extended position of the internal tube.

In the area of the fastening part, the foot is advantageously thicker in the lifting direction so that the recess for receiving the internal tube has a sufficient depth.

Advantageously, the bottom of the recess in the end face of the fastening part has a spacing from the bottom of the recess of the foot which spacing is greater, advantageously multiple times greater, than the projecting portion of the fastening part projecting past the topside of the foot. This projecting portion can be, for example, three to four times the thickness of the foot. In this way, the foot, on the one hand, can still be relatively thin but can still enable a great lifting stroke of the lifting column.

Further features of the invention result from the further claims, the description, and the drawings.

BRIEF DESCRIPTION OF THE DRAWINGS

The invention will be explained in more detail with the aid of one embodiment illustrated in the drawings. It is shown in.

DESCRIPTION OF PREFERRED EMBODIMENT

Figure 1:
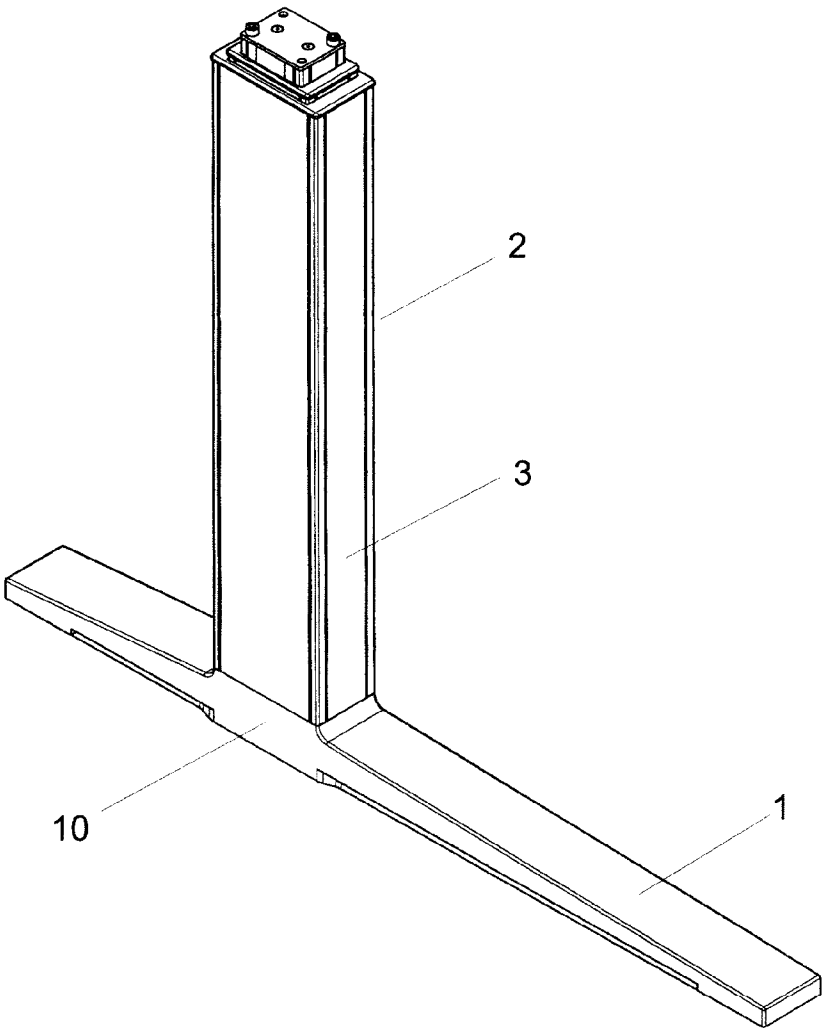
FIG. 1 in a perspective illustration a height-adjustable furniture leg according to the invention.

The furniture leg can be utilized in connection with tables of any kind, chairs, organ benches, and the like. Depending on the type of the piece of furniture, two or several furniture legs can be used for the respective piece of furniture. The furniture leg has the foot 1 which in the embodiment is an elongate foot rail. The foot 1 can also have any other suitable shape. A column 2 projects perpendicularly from the foot 1 and is embodied as a telescopic column. It has an external tube 3 attached to the foot 1. The external tube 3 surrounds at least one internal tube 4. In the illustrated embodiment, between the external tube 3 and the internal tube 4 there is a central tube 5. The tubes 3 to 5 are inserted into one another in a telescoping fashion and are axially moved relative to one another as is known in the art. The bearings that are provided between the tubes 3 to 5 are not illustrated in FIG. 2. The drive 6 is arranged in the column 2 for a telescoping driving action; the drive is embodied in a way known in the art and will therefore not be explained in more detail. The drive is seated on a plate 7 that is attached to the bottom 8 of a recess 9. The recess 9 is provided in a fastening part 10; advantageously, fastening part and foot 1 form a unitary part wherein the fastening part projects past the topside 15 of the foot. The external tube 3 is attached to the fastening part 10, for example, by welding. For centering the external tube 3 in the end face 11 of the fastening part 10 a circumferentially extending recess 12 is provided that is outwardly open; the external tube 3 engages this recess and rests against the bottom of the recess 12. The width of the recess 12 corresponds to the wall thickness of the external tube 3. In this way, the external tube 3 is aligned in a simple way relative to the fastening part 10 during assembly. Moreover, the outer wall 13 has a continuous transition into the exterior side 14 of the fastening part 10. A disruptive step at the transition from the fastening part 10 to the external tube 3 is not present.

The fastening part 10 is designed such that it projects upwardly past the topside 15 of the foot 1. The fastening part

Figure 2:
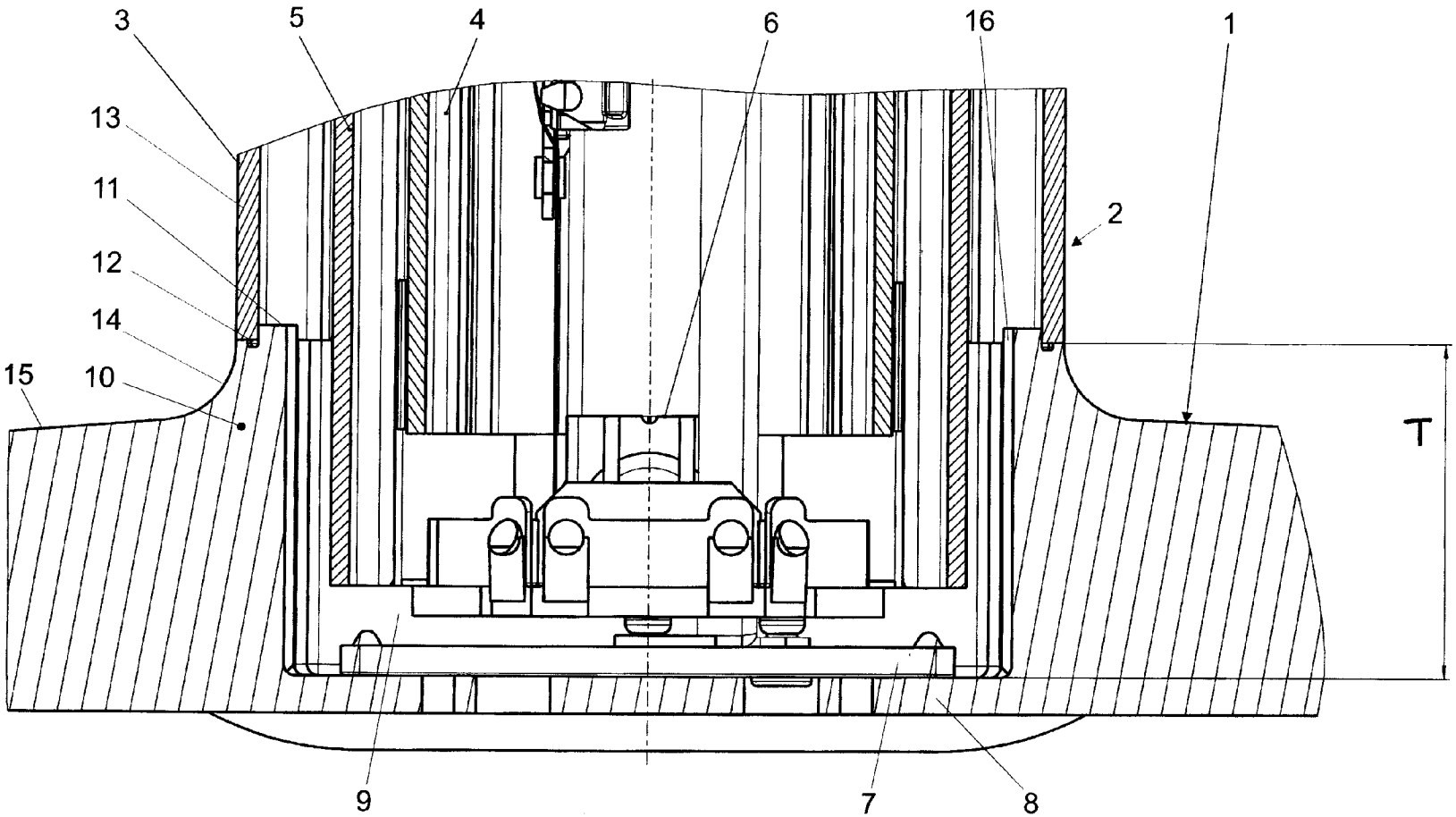
FIG. 2 in an enlarged illustration and in section the lower end of the furniture leg according to FIG. 1.

10 delimits with its interior side 16 the recess 9 that extends to the bottom 8. The central tube 5 can be retracted very far into the recess 9 relative to the external tube 3. The internal tube 4 can also be moved far into the recess 9. The central tube 5 can be moved maximally to such an extent that it hits the plate 7 or has only a minimal spacing relative to it. The internal tube 4 can be moved so far downwardly into the recess 9 that it stops at a part of the drive 6. In FIG. 2, the distance between the bottom of the circumferentially extending recess 12 and the bottom 8 of the recess 9 is identified by T. The central tube 5 and the internal tube 4 can be moved by this distance past the external tube 3 into the lower end position. The column 2 can therefore have a great lifting height in the lowermost position of the tubes 4, 5. In the retracted position, the internal tube 4 and the central tube 5 project in the direction toward the bottom 8 of the recess 9 past the external tube 3.

The contour shape of the bearing part 10 matches the contour shape of the external tube 3 that has a rectangular contour in the illustrated embodiment. The tubes 3 to 5 can also have a round, non-round or any other suitable contour shape. The fastening part 10 of the foot 1 is matched to the respective contour shape in such a way that the transition from the external tube 3 to the exterior side of the fastening part 10 is continuous.

The column 2 can be adjusted motorically by means of the drive 6 with regard to height. A manual adjusting action for the telescoping tubes 4, 5 of the column 2 is also possible.

Depending on the depth of the recess 9 or the height of the fastening part 10, the spacing T can be adjusted. The furniture leg has only a minimal height when the column 2 is retracted so that a part attached to the furniture leg, for example, a seat, a tabletop, and the like can have a desired low height. Despite this minimal height of the furniture leg, the column 2, as a result of the distance T, can be extended very far so that a great lifting stroke results.

The distance T is multiple times greater than the projecting fastening part 10 that projects past the topside 15 of the foot 1. The foot 1 is thicker in the lifting direction of the column 2 for forming the fastening part 10.

What is claimed is:

1. A height-adjustable furniture leg comprising:

at least one foot having a fastening part;

a lifting column connected to the at least one foot and projecting transversely from the at least one foot;

wherein the lifting column comprises an external tube and at least one internal tube movable relative to the external tube telescopingly, wherein the external tube is attached to the fastening part;

wherein the external tube has an exterior side that, at least over most of a circumference of the exterior side, continuously passes into an exterior side of the fastening part;

wherein the fastening part has a first recess;

wherein a lower end of the at least one internal tube is retractable into the first recess in a lowered position;

a drive arranged in the first recess and connected to the at least one internal tube for moving the at least one internal tube relative to the external tube, wherein the drive is supported on the bottom of the first recess;

wherein the bottom of the first recess is located at a bottom side of the at least one foot.

2. The furniture leg according to claim 1, wherein the fastening part projects past a topside of the at least one foot.

3. The furniture leg according to claim 1, wherein the external tube is centered on the fastening part.

4. The furniture leg according to claim 1, wherein the fastening part has an end face that faces the lifting column and is provided with a second recess, wherein a lower end of the external tube engages the second recess.

5. The furniture leg according to claim 4, wherein a width of the second recess matches a wall thickness of the external tube.

6. The furniture leg according to claim 4, wherein the second recess is open toward the exterior side of the fastening part.

7. The furniture leg according to claim 4, wherein a bottom of the second recess is positioned at a distance from a bottom of the first recess, wherein the distance is multiple times greater than a projecting portion of the fastening part which projecting portion projects upwardly past a topside of the at least one foot.

8. The furniture leg according to claim 1, wherein the at least one foot in the area where the external tube is connected has a thick portion extending in the lifting direction and the thick portion forms the fastening part as an integral part of the at least one foot.

* * * * *